US011067291B2

(12) United States Patent
Kweon et al.

(10) Patent No.: US 11,067,291 B2
(45) Date of Patent: Jul. 20, 2021

(54) COOKING APPARATUS HAVING HOOD

(71) Applicant: SAMSUNG ELECTRONICS CO., LTD., Suwon-si (KR)

(72) Inventors: Soon Cheol Kweon, Seoul (KR); Hee Yuel Roh, Suwon-si (KR); You Seop Lee, Yongin-si (KR); Ki Hwan Kwon, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 155 days.

(21) Appl. No.: 16/347,946

(22) PCT Filed: Oct. 18, 2017

(86) PCT No.: PCT/KR2017/011499
§ 371 (c)(1),
(2) Date: May 7, 2019

(87) PCT Pub. No.: WO2018/084463
PCT Pub. Date: May 11, 2018

(65) Prior Publication Data

US 2019/0285284 A1 Sep. 19, 2019

(30) Foreign Application Priority Data

Nov. 7, 2016 (KR) ..... 10-2016-0147520

(51) Int. Cl.
*F24C 15/20* (2006.01)
*H05B 6/64* (2006.01)
(Continued)

(52) U.S. Cl.
CPC ..... *F24C 15/2042* (2013.01); *F24C 15/20* (2013.01); *F24F 7/06* (2013.01); *F24F 9/00* (2013.01); *H05B 6/64* (2013.01)

(58) Field of Classification Search
CPC ..... F24C 15/2042; F24C 15/20; F24F 7/06; F24F 9/00; H05B 6/64
See application file for complete search history.

(56) References Cited

U.S. PATENT DOCUMENTS 5,050,581 A * 9/1991 Rohl-Hager ..... F24C 15/20 126/299 D
2005/0051159 A1* 3/2005 Yamada ..... F24C 15/20 126/299 R (Continued)

FOREIGN PATENT DOCUMENTS

JP 2000-130807 5/2000
JP 2012-55839 3/2012

(Continued)

OTHER PUBLICATIONS

International Search Report dated Jan. 26, 2018 in corresponding International Application No. PCT/KR2017/011499.

(Continued)

*Primary Examiner* — Alfred Basichas
(74) *Attorney, Agent, or Firm* — Staas & Halsey LLP

(57) ABSTRACT

A cooking apparatus having a hood according to the disclosure may increase suction performance of a blower fan by arranging the blower fan beneath a cooking chamber to force air to be inhaled into the housing as a whirling current of air, and improve suction performance of the blower fan by arranging at least one auxiliary outlet around and outside the blower fan for some of the inhaled air to be discharged downward to form an air curtain around the inlet. Furthermore, a duct may be formed inside the housing of the cooking apparatus having the hood for an inhaled substance through the inlet to be easily moved to the outlet.

13 Claims, 15 Drawing Sheets

(51) Int. Cl.
*F24F 9/00* (2006.01)
*F24F 7/06* (2006.01)

(56) References Cited

U.S. PATENT DOCUMENTS

| | | | | |
|---|---|---|---|---|
| 2006/0154590 | A1* | 7/2006 | Kanaya | F24F 7/06 454/56 |
| 2006/0175322 | A1* | 8/2006 | Beak | F24C 15/20 219/757 |
| 2016/0150601 | A1* | 5/2016 | Kim | F24C 15/2042 219/757 |
| 2016/0273779 | A1* | 9/2016 | Kim | F24C 15/2028 |

FOREIGN PATENT DOCUMENTS

| | | |
|---|---|---|
| KR | 97-70801 | 11/1997 |
| KR | 2000-0051144 | 8/2000 |
| KR | 10-2004-0008853 | 1/2004 |

OTHER PUBLICATIONS

Written Opinion of the International Searching Authority dated Jan. 26, 2018 in corresponding International Application No. PCT/KR2017/011499.

* cited by examiner

COOKING APPARATUS HAVING HOOD

CROSS-REFERENCE TO RELATED APPLICATIONS

This application is a U.S. National Stage Application which claims the benefit under 35 U.S.C. § 371 of International Patent Application No. PCT/KR2017/011499 filed on Oct. 18, 2017, which claims foreign priority benefit under 35 U.S.C. § 119 of Korean Patent Application No. 10-2016-0147520 filed on Nov. 7, 2016 in the Korean Intellectual Property Office, the contents of both of which are incorporated herein by reference.

TECHNICAL FIELD

The present disclosure relates to a cooking apparatus having a hood, and more particularly, to a hood.

BACKGROUND ART

A cooking apparatus having a hood is installed above e.g., a cooktop to additionally perform a hood function to exhaust heat and smoke generated from the cooktop. A type of cooking apparatus having a hood, which is often used, includes an oven with a hood or a microwave oven with a hood.

The microwave oven (MVO) typically cooks food with heat due to intermolecular friction generated by breaking arrangement of molecules in food using high frequency as a heating source.

A cooking chamber in which food is cooked is provided inside the body of the microwave oven with a hood, and a blower fan is additionally provided to blow out smoke generated from the cooktop in order to serve as a hood.

In the case of such a microwave oven with a hood, the size of the blower fan or a driving motor to drive the blower fan may be somewhat limited to perform the two functions. Accordingly, a need exists to increase the suction effect of the microwave oven having a hood.

DISCLOSURE

Technical Problem

The disclosure provides a cooking apparatus having a hood with improved suction efficiency.

Technical Solution

In accordance with an aspect of the disclosure, a cooking apparatus having a hood includes a housing including an outlet and an inlet; a cooking chamber arranged inside the housing; a blower fan arranged between a bottom side of the cooking room and the housing; and at least one auxiliary outlet formed on a bottom side of the housing and arranged around and outside the blower fan, wherein the at least one auxiliary outlet is arranged along a circumferential direction of the blower fan.

The blower fan may be configured to rotate around a rotation axis aligned vertically to the housing, and force inhaled air inhaled into the housing to be rotated in the circumferential direction of the blower fan.

The at least one auxiliary outlet may be provided for some of the inhaled air inhaled into the housing to be discharged down from the housing.

The blower fan may be a centrifugal fan, and may include a plurality of disc plates layered vertically.

Among the plurality of disc plates, a plurality of disc plates arranged in a lower side may be configured to force some of the inhaled air brought into the housing to be moved to the at least one auxiliary outlet.

The cooking apparatus having the hood may further include a discharging guide arranged around and outside the plurality of disc plates arranged in the lower side among the plurality of disc plates to guide some of the inhaled air to the at least one auxiliary outlet.

The cooking apparatus having the hood may further include an suction guide guiding the inhaled air into the housing in a direction in which the blower fan is rotated and including a plurality of guide wings radially formed at the inlet.

The plurality of guide wings may be arranged at an upward inclined angle in a rotational direction of the blower fan.

The at least one auxiliary outlet may include a guide plane to guide some of the inhaled air to be discharged at the inclined angle with the rotation axis, and the guide plane may be formed at an inclined angle with the rotation axis toward the inside of the housing.

The guide plane of some of the at least one auxiliary outlet arranged in a front area with respect to the rotation axis may have a different inclined angle from the guide plane of the other of the at least one auxiliary outlet arranged in a rear section with respect to the rotation axis.

The guide plane of each of the at least one auxiliary outlet may have a different inclined angle.

The cooking apparatus having the hood may further include a front auxiliary outlet formed toward the front of the housing for some of the inhaled air brought into the housing to be discharged toward the front of the housing.

The cooking apparatus having the hood may further include a duct linked from the inlet to the outlet.

The cooking apparatus having the hood may further include an electric room arranged on a side to the cooking chamber and having electric parts arranged in the electric room, and the duct may include an electric room inlet provided for the inhaled air brought into the housing to be moved into the electric room, and an electric room outlet provided for the inhaled air brought into the electric room to be discharged.

In accordance with another aspect of the disclosure, a cooking apparatus having a hood includes a housing, an outlet arranged on the top of the housing, an inlet arranged on the bottom of the housing, a cooking chamber arranged inside the housing, a blower fan arranged between the bottom of the cooking chamber and the housing, a duct to link the inlet to the outlet for inhaled air brought by the blower fan into the housing through the inlet to be moved to the outlet, and an auxiliary outlet arranged on the bottom of the housing for some of the inhaled air to be discharged down from the housing, wherein the auxiliary outlet is provided for some of the inhaled air discharged down from the housing to form an air curtain around the inlet.

The auxiliary outlet may be provided in the plural, and the plurality of auxiliary outlets may be arranged around and outside the blower fan in the circumferential direction of the blower fan.

The blower fan may be configured to rotate around a rotation axis aligned vertically to the housing, and force inhaled air inhaled into the housing to be rotated in the circumferential direction of the blower fan as a whirling current of air.

The duct may include a first flow path extending upward along a side of the housing, a second flow path extending upward along the other side of the housing, and a discharging flow path connecting the first flow path to the second flow path to allow inhaled air brought into the housing to be moved to the outlet.

The cooking apparatus having the hood may further include an electric room arranged between a side of the cooking room and a side of the housing and having electric parts arranged in the electric room, and the first flow path may include an electric room inlet provided for some of inhaled air moving around through the first flow path to be moved into the electric room, and an electric room outlet provided for the inhaled air brought into the electric room to be discharged out of the electric room.

The discharging flow path may include a first opening linked to the first flow path, a second opening linked to the second flow path, and a third opening linked to the outlet, wherein the third opening may be arranged selectively toward the front, top, and rear of the housing.

Advantageous Effects

According to the disclosure, a cooking apparatus having a hood may include a blower fan arranged on a lower side of a housing to increase suction performance, and discharge some of inhaled air to form an air curtain to efficiently inhale air near the microwave oven having a hood, thereby increasing suction efficiency.

MODE FOR INVENTION

Figure 1:
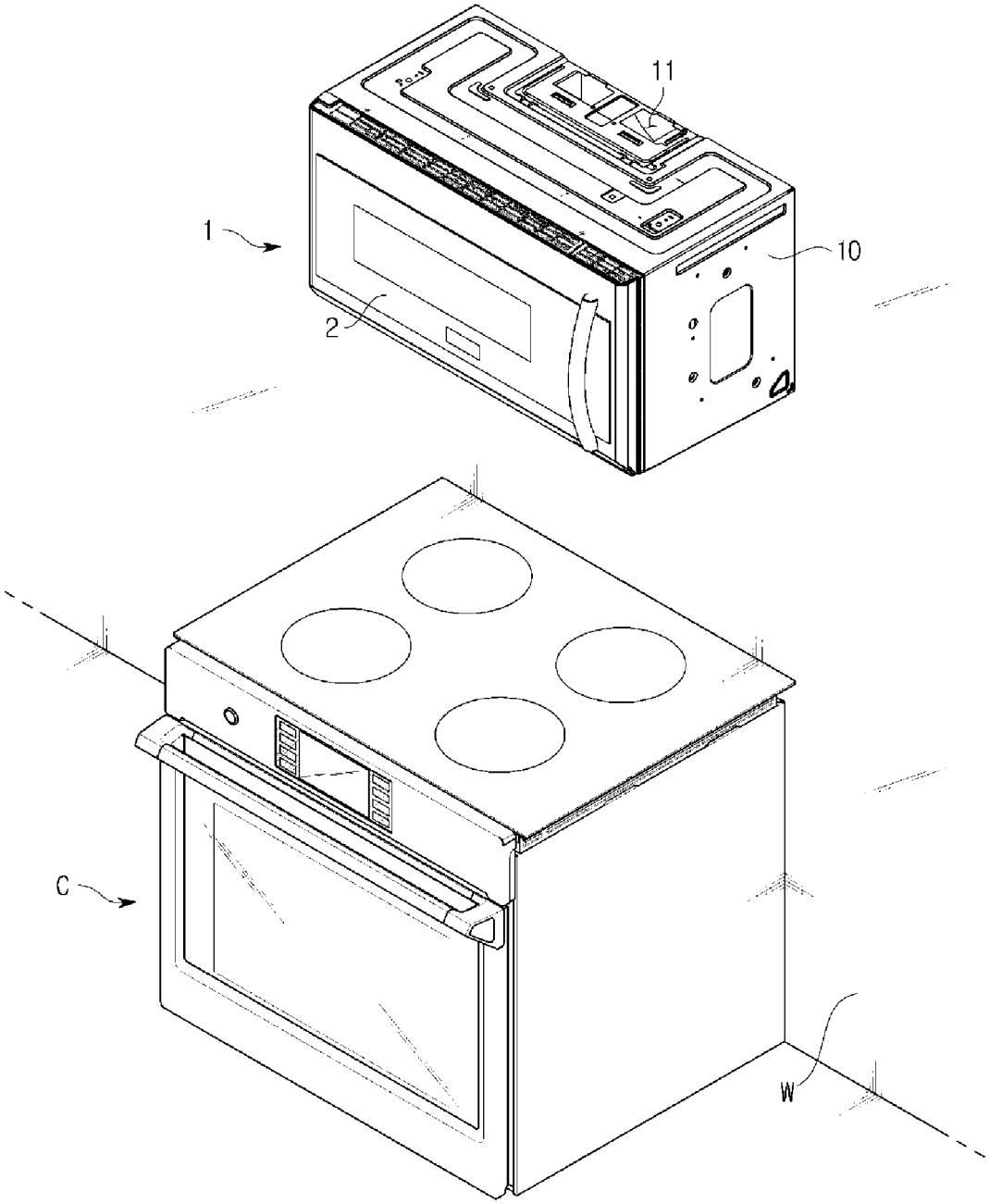
FIG. 1 is a perspective view of a microwave oven having a hood, according to an embodiment of the disclosure.

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

The terms 'upper', 'upward', 'lower', and 'downward' as herein used are defined with respect to a vertical direction of a cooking apparatus having a hood according to an embodiment of the disclosure as shown in FIG. 1, and in FIG. 1, it is defined that the cooking apparatus having a hood is placed on the upper side and a cooktop down there is placed on the lower side.

The terms 'front', 'rear', 'front side', and 'rear side' as herein used are defined with respect to the cooking apparatus having a hood as shown in FIG. 1 where a side where a door is placed is defined to be the front and the opposite side is defined to be the rear side.

Furthermore, based on the orientation of the cooking apparatus having a hood as shown in FIG. 1, the left of the front side and the right of the front side are defined to be 'left side' and 'right side', respectively.

In the disclosure, as an example of the cooking apparatus having a hood, a microwave oven having a hood will be described. Embodiments of the disclosure are not, however, limited to the microwave oven having a hood, and may be applied to any cooking apparatus having a hood, such as an oven having a hood.

Reference will now be made in detail to embodiments, examples of which are illustrated in the accompanying drawings, wherein like reference numerals refer to the like elements throughout.

Figure 2:
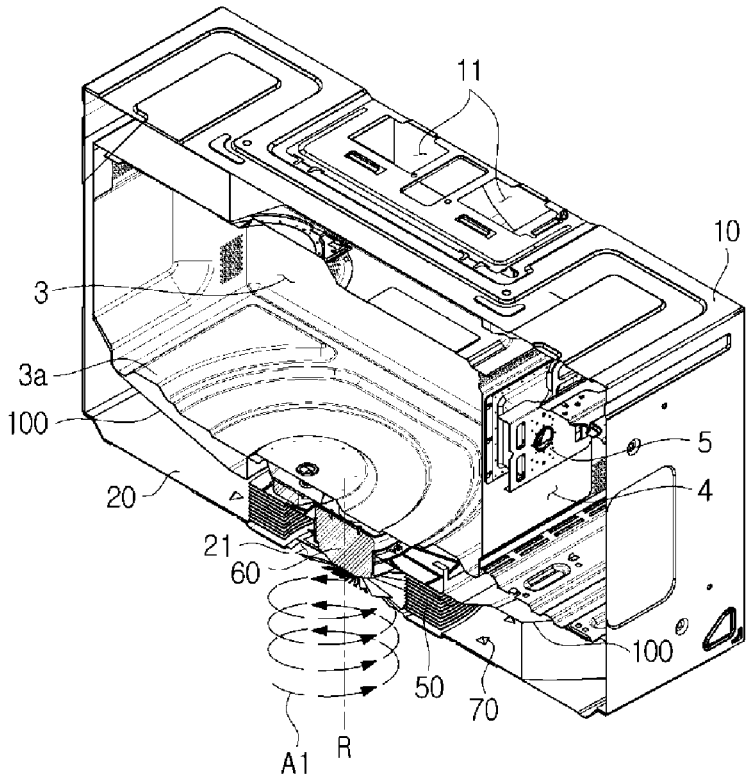
FIG. 2 is a cross-sectional view of a microwave oven having a hood, according to an embodiment of the disclosure.

As shown in FIGS. 1 and 2, a microwave oven having a hood 1 may be installed a distance above a cooktop type of cooking apparatus C such as a gas stove or an induction range. The microwave oven having a hood 1 may have the form of almost a cuboid housing to be fixedly installed on a wall W of a building.

The microwave oven having a hood 1 may include an upper housing 10 and a lower housing 20, which form the exterior. The upper housing 10 may form the exterior of the top, sides, and rear of the microwave oven having a hood 1. The upper housing 10 may be provided with the top, sides, and rear parts in an integrated form or separated form (Hereinafter, the upper housing 10 and the lower housing 20 will be collectively called a housing 10, 20).

The front of the housing 10, 20 is opened, and a door 2 may be provided on the open front to open or close the front.

The lower housing 20 may form the exterior of the bottom of the microwave oven having a hood 1. An inlet 21 may be provided on the lower housing 20 to inhale smoke or something generated from the cooking apparatus C.

An outlet 11 may be provided on the top of the upper housing 10 for inhaled air brought in through the inlet 21 to be discharged out from inside the housing 10, 20.

As will be described later in detail, the outlet 11 may be arranged not only on the top of the upper housing 10 but also on the rear or the front.

Inside the housing 10, 20, a cooking chamber 3 for cooking food may be arranged on one side and an electric room 4 partitioned off from the cooking chamber 3 may be provided to have various electric parts installed therein. The cooking chamber 3 may be opened to the front and may be opened or closed by the door 2.

In the electric room 4, there may be electric parts, such as a magnetron 5 for generating microwaves to be irradiated to the cooking chamber 3, a high-voltage transformer (not shown) configuring a driving circuit to drive the magnetron 5, a high-voltage condenser (not shown), a high-voltage diode (not shown), etc. Furthermore, a cooling fan (not shown) may be arranged inside the electric room 4 for inhaling outside air to cool the various electric parts inside the electric room 4.

A blower fan 50 and an auxiliary outlet 70 according to an embodiment of the disclosure will now be described in detail.

In a case of a conventional cooking apparatus having a hood, there is a blower fan provided in an upper portion of the housing, which is adjacent to the outlet, to improve exhausting performance, and the size of the fan or the number of revolutions of the motor is increased to increase the flow rate of the blower fan.

However, in this case, problems arise because the increase in the size of the blower fan reduces capacity of the cooking chamber or the electric room and the increase in the number of revolutions of the motor increases noise.

Hence, the blower fan 50 according to an embodiment of the disclosure may be provided to have a fan with a long radius extending in the horizontal direction around a vertical rotation axis to inhale more air even at a low number of revolutions of the motor 51.

Figure 3:
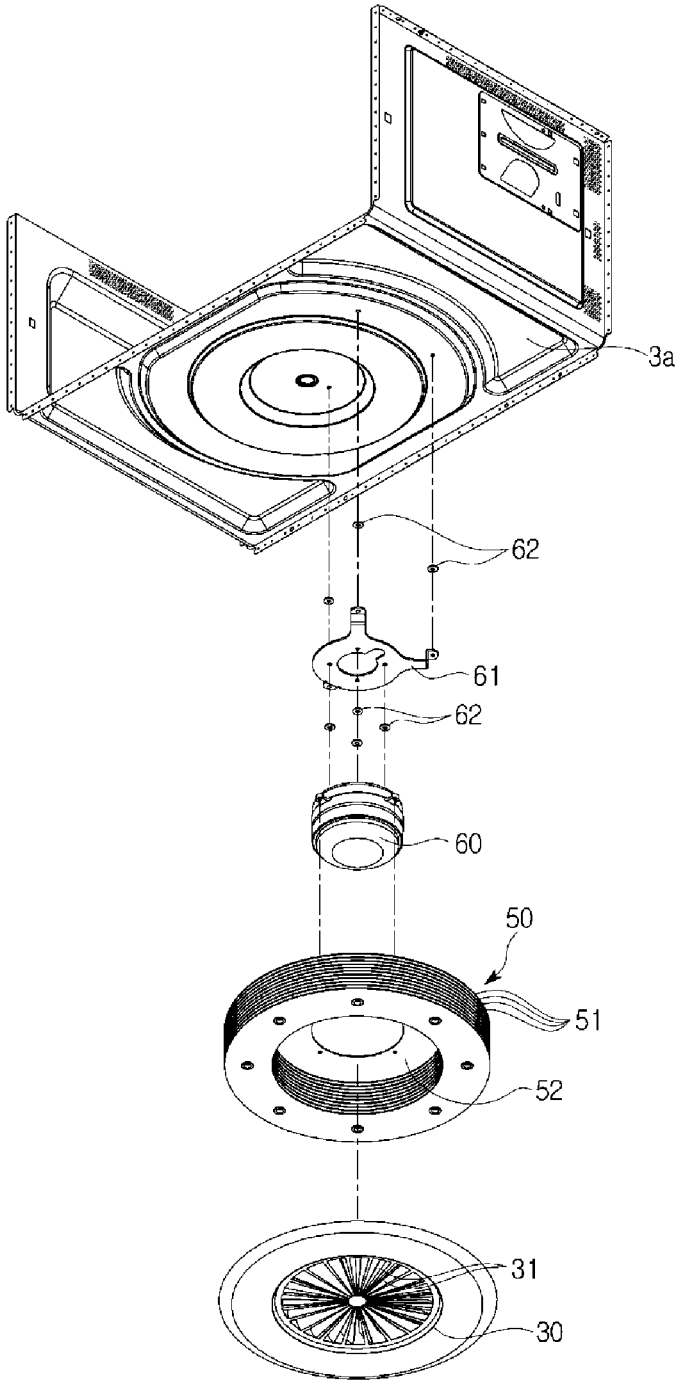
FIG. 3 is an exploded view of some parts of a microwave oven having a hood, according to an embodiment of the disclosure.

As shown in FIGS. 2 to 3, the blower fan 50 may be arranged between the bottom side of the cooking chamber housing 3*a* forming the cooking chamber 3 and the lower housing 20.

The blower fan 50 may be provided with a plurality of discs 52 layered with a distance from each other in the vertical direction or i.e., in the up-down direction, of the housing 10, 20.

The blower fan 50 may be arranged at almost near the center of the lower housing 20 and provided as a centrifugal fan with a rotation axis R aligned along the vertical direction of the housing 10, 20.

This structure enables the blower fan 50 to blow the vertically inhaled air to the horizontal direction, in which case the air inhaled through the blower fan 50 may be moved into a lower portion of the housing 10, 20, moved upward, and discharged out of the housing 10, 20 through the outlet 11 formed on the top. This will be described later in detail.

The plurality of discs 52 have a radius extending in the horizontal direction to the housing 10, 20 and thus may have horizontal planes to the housing 10, 20. In the conventional occasion, as the blower fan is arranged near the top of the housing or on one side of the cooking chamber, length of the radius of the blower fan is limited. On the contrary, according to an embodiment of the disclosure, as the blower fan 50 is arranged between the bottom of the cooking chamber 3 and the lower housing 20, the fan, i.e., the plurality of discs 52 in the embodiment may extend longer than the conventional blower fan because there is nothing standing near the blower fan 50 in a way in which the radius of the fan, i.e., the plurality of discs 52, extend.

On the rotation axis C of the plurality of discs 52, a motor 60 may be arranged. Specifically, the motor 60 is arranged in the center of the blower fan 50, and as the blower fan 50 may be provided as a centrifugal fan, the motor 60 may be arranged in a flow path of the air inhaled through the blower fan 50 and thus may have an effect of being cooled naturally by the air inhaled when the motor 60 is driven.

The motor 60 may be driven at a lower number of revolutions than the conventional motor, because the large radius of the plurality of discs 52 allows large suction of air at the lower number of revolutions, thereby reducing noise from rotation of the motor 60.

The motor 60 may be coupled with the blower fan 50 by a coupling member 52 of the blower fan 50 coupled with the outer circumference of the motor 60 to transmit the rotation force generated by the motor 60 to the blower fan 50.

The motor 60 may be coupled onto the bottom of the cooking chamber housing 3*a* through a motor bracket 61. A side of the motor bracket 61 may be coupled onto the bottom of the cooking chamber housing 3*a* and the other side may be coupled to the motor 60.

Anti-vibration members 62 may be provided between the motor 60 and the motor bracket 61 and between the motor bracket 61 and the cooking room housing 3*a* to reduce noise. The anti-vibration member 62 may prevent vibrations generated from the motor 60 from being transferred to the entire microwave oven having a hood 1, and thus, may reduce the noise generated from the microwave oven having a hood 1.

As described above, the blower fan 50 may be rotated around the rotation axis directed in the vertical direction of the housing 10, 20, i.e., in the up-down direction, and arranged to be adjacent to the inlet 21, so that the inhaled air A1 flowing to the housing 50 may be formed into a rotating air current that moves upward.

In other words, inhaled air A1 moving to the housing 50 is moved in through the inlet 21 while forming a whirlwind, which may efficiently move the inhaled air A1 to the inside of the housing 10, 20 and thus increase capture efficiency of the microwave oven having a hood 1.

Specifically, when the motor 60 is rotated at the same number of revolutions as the conventional motor, the capture efficiency may increase about 35% over the conventional occasion. The capture efficiency may be determined by a difference in carbon dioxide exhaustion evaluated as a ratio of carbon dioxide in the air exhausted from the microwave oven having a hood to an amount of carbon dioxide thrown into the space where the cooktop C is placed using a carbon dioxide generator that simulates harmful gases generated from cooking of food.

In summary, the blower fan 50 according to an embodiment of the disclosure is arranged to be adjacent to the inlet 21 on the bottom of the cooking chamber 3, allowing the inhaled air A1 moving to the housing 10, 20 to be moved into the housing 10, 20 while being rotated as the blower fan 50 is rotated in the horizontal direction of the housing 10, 20, thereby increasing the capture efficiency of the microwave oven having a hood 1.

Figure 4:
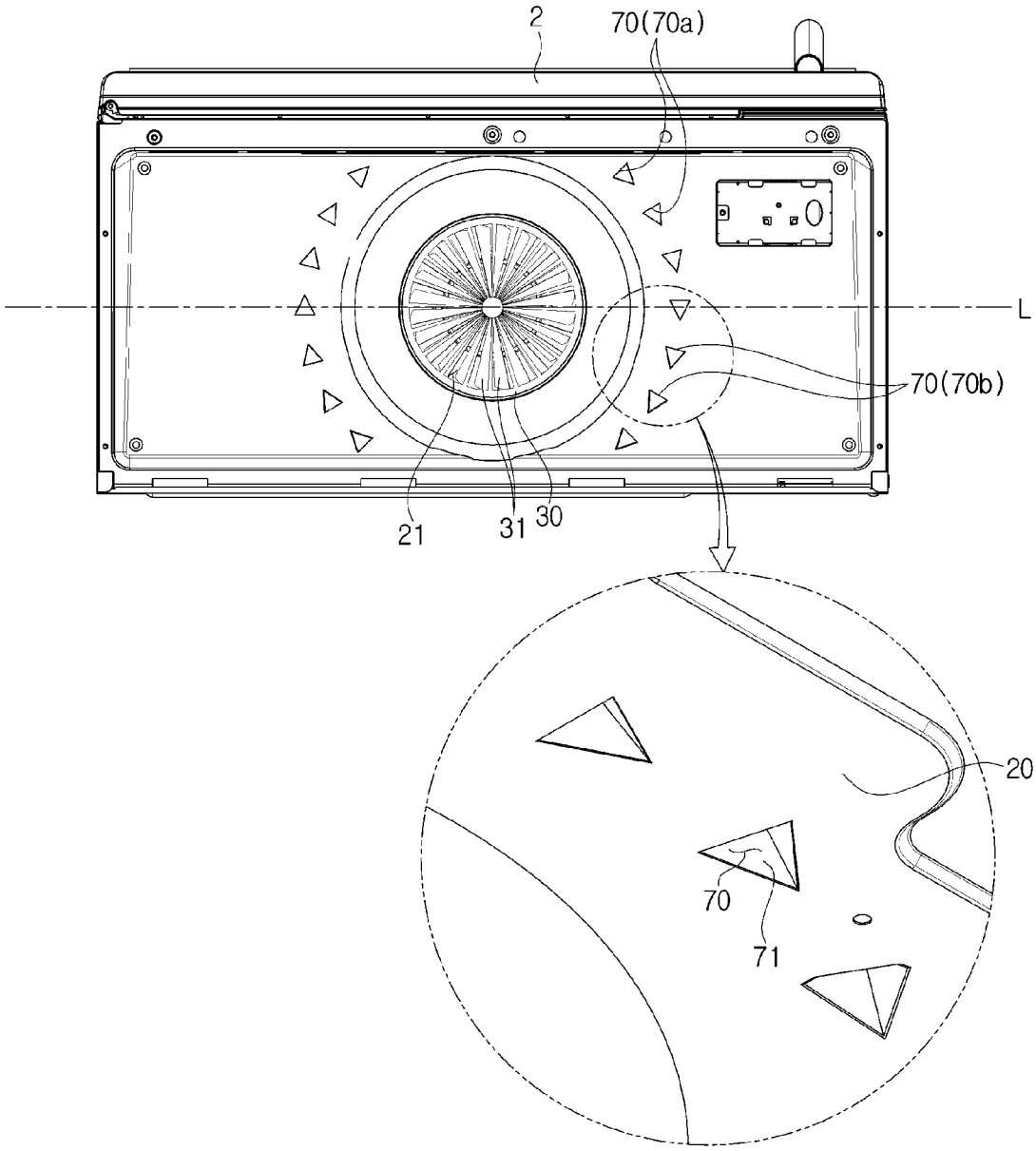
FIG. 4 is a bottom view of a microwave oven having a hood, according to an embodiment of the disclosure.
Figure 5:
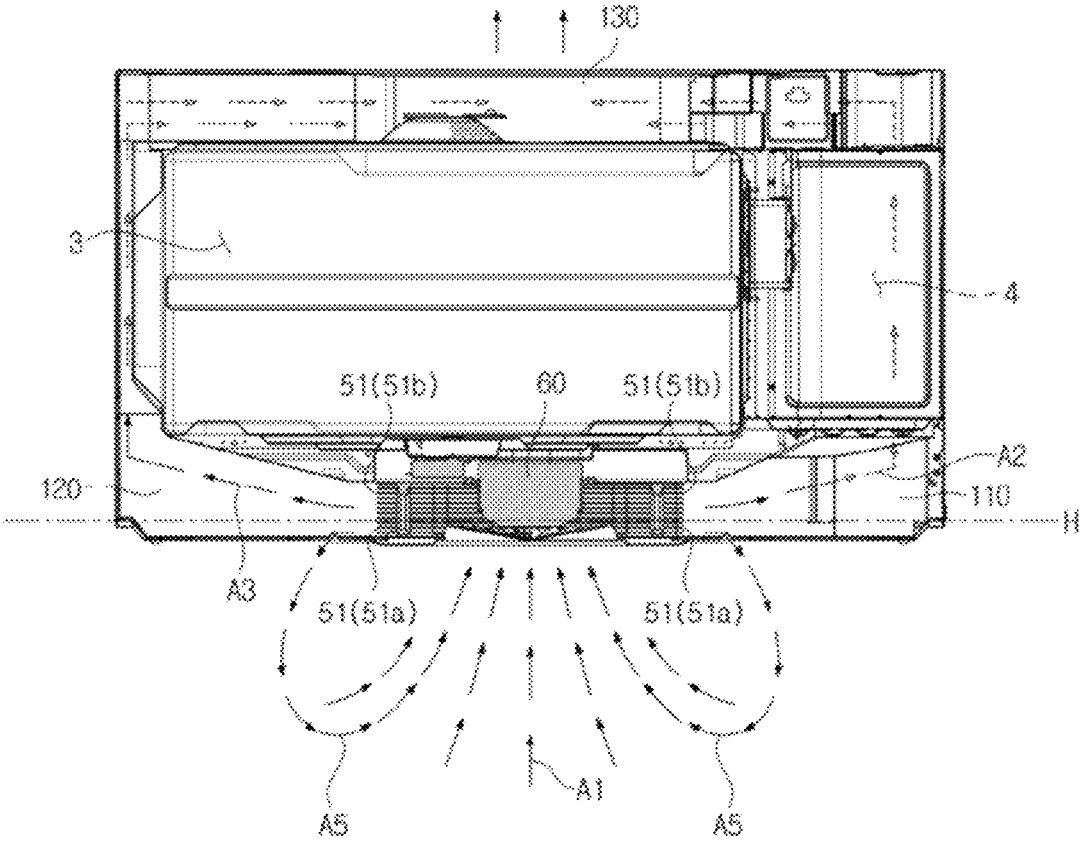
FIG. 5 schematically shows a cross-section of part of a microwave oven having a hood and flows of inhaled air, according to an embodiment of the disclosure.
Figure 6:
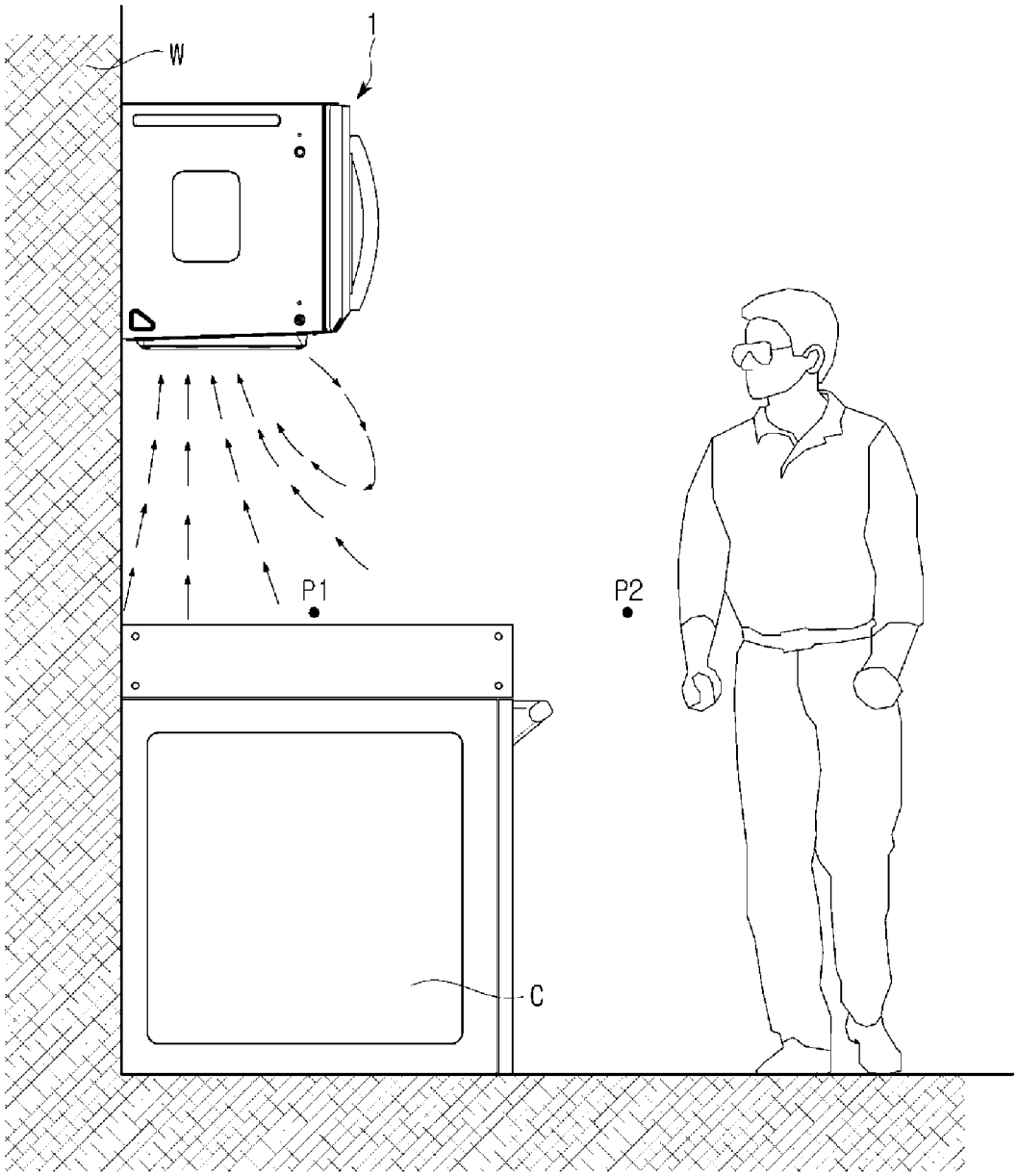
FIG. 6 is a side view of flows of inhaled air formed by a cross-section of part of a microwave oven having a hood, according to an embodiment of the disclosure.

As shown in FIGS. 4 to 6, the microwave oven having a hood 1 according to an embodiment of the disclosure may further include an auxiliary outlet 70 for some of inhaled air A2 and A3 brought into the housing 10, 20 to be discharged, apart from the outlet 11.

Specifically, the inhaled air A2 and A3 brought into a lower portion of the housing 10, 20 through the inlet 21 formed on the lower housing 20 may be moved up inside the housing 10, 20, and discharged through the outlet 11 arranged on the top of the upper housing 10.

More specifically, the inhaled air A2 and A3 brought into the housing 10, 20 may form a rising current of air inside the housing 10, 20 such that some of the inhaled air A2 and A3 moving upward may be moved down again through the auxiliary outlet 70 formed on the lower housing 20 without rising to the top of the housing 10, 20, thus producing inhaled air A5 to be discharged down from the housing 10, 20.

As shown in FIG. 5, the inhaled air A5, some of the inhaled air brought into the housing 10, 20, may be discharged down from the housing 10, 20 through the auxiliary outlet 70 without moving upward.

The inhaled air A5 may be discharged down from the housing 10, 20 near the inlet 21 through the auxiliary outlet 70 arranged outside the inlet 21 in the radial direction of the inlet 21, and the discharged air may move back to the inlet 21 by the blower fan 50, producing an air curtain.

Specifically, air discharged from lower discs 51*a* among the plurality of discs 51, that are layered down from a base height H in the vertical direction, may be blown toward the auxiliary outlet 70 and air from upper discs 51*b* arranged above the lower discs 51*a* may be blown toward the outlet 11, so that there may be two flow paths formed inside the housing 10, 20.

Formed are a first flow path in which the inhaled air A2 and A3 brought into the housing 10, 20 is directed toward the outlet 11 and a second flow path in which the inhaled air A5, some of the inhaled air brought into the housing 10, 20, is directed to the auxiliary outlet 70.

Some of the plurality of discs 51 which are rotated to force the inhaled air A2 and A3 brought into the housing 10, 20 to be moved into the first flow path, and the others of the plurality of discs 51 which guides movement of the air into the second flow path may be divided in the vertical direction based on the base height H.

The base height H is a variable height changing depending on rotation force of the motor 60 and extension length of the plurality of discs 51 in the radial direction.

The inhaled air A2 and A3 moving in the first flow path and the inhaled air A5 moving in the second flow path may all be divided from the inhaled air A1 brought into the housing through the inlet 21, and the inhaled air A5, some of the inhaled air brought into the housing 10, 20, discharged from the second flow path may move back into the housing 10, 20 after joining the inhaled air A1 moving into the housing through the inlet 21.

The inhaled air A5, some of the inhaled air brought into the housing 10, 20, may form an air curtain to be adjacent to an outer side of the inlet 21 in the radial direction of the inlet 21. The air curtain formed through the auxiliary outlet 70 may serve as an air shield that encloses the outside of the inhaled air A1 inhaled into the housing 10, 20, and simultaneously, may increase the capture efficiency of the microwave oven having a hood 1 by increasing rotational power of the inhaled air A1.

Specifically, as shown in FIG. 6, the air curtain formed to be adjacent to the inlet 21 may form an air shield for an object to be inhaled by the microwave oven having a hood 1, e.g., smoke generated from a food being cooked by the cooktop C, to be intensely inhaled. Accordingly, air at a first point P1 above the cooktop C may be captured by the microwave oven having a hood 1 more efficiently than air at a second point p2 in a space not above the cooktop C.

Furthermore, the air curtain may be formed on outside of the inlet 21 in the radial direction of the inlet 21, enclosing the outside of the inhaled air A1 being inhaled into the housing 10, 20, thereby increasing rotational power of the inhaled air A1 being inhaled into the housing 10, 20. As whirls of the inhaled air A1 to be inhaled into the housing 10, 20 increase accordingly, an amount of captured inhaled air increases and thus overall capture efficiency of the microwave oven having a hood 1 may increase.

As the auxiliary outlet 70 is formed, the capture efficiency of the microwave oven having a hood 1 is increased about 15% over the capture efficiency of a microwave oven having a hood that has no auxiliary outlet 70.

As described above, for the inhaled air A5, some of the inhaled air inhaled into the housing 10, 20, to form an air curtain around and outside the inlet 21, the auxiliary outlet 70 may be arranged around and outside the blower fan 50 in the circumferential direction of the blower fan 50.

Specifically, as shown in FIGS. 4 and 5, there may be one or more auxiliary outlets 70, which may be arranged around and outside the blower fan 50, or to put it differently, may be arranged around and outside the inlet 21, and the plurality of auxiliary outlets 70 may be arranged in the circumferential direction of the blower fan 50 or the inlet 21.

The auxiliary outlet 70 may be provided as an opening formed toward the lower side of the lower housing 20. This may enable the inhaled air A5, some of the inhaled air brought into the housing 10, 20, to be discharged down from the lower housing 20 through the auxiliary outlet 70.

A guide plane 71 for guiding the inhaled air A5, some of the inhaled air brought into the housing 10, 20, to the auxiliary outlet 70 may be provided on an inner side of the lower housing 20 where the auxiliary outlet 70 is formed.

Specifically, the guide plane 71 may be provided in the form of an extension plane that extends from a side of the auxiliary outlet 70 to the inner side of the housing 20 at an inclined angle. That is, the guide plane 71 may extend at an inclined angle with the lower housing 20. According to an embodiment of the disclosure, the auxiliary outlet 70 may have the form of a triangle, and two extension planes extending from two of the three sides of the triangle may form the guide plane 71.

Embodiments of the disclosure are not, however, limited thereto, and the auxiliary outlet 70 may have any other form than the triangle, and accordingly, the guide plane 71 may also be formed in various forms without being limited to the two triangular planes while maintaining an inclination to the lower housing 20.

As the guide plane 71 is formed at an inclined angle with the lower housing 20, the inhaled air A5, some of the inhaled air brought into the housing 10, 20, may be discharged with an inclined angle to the vertical direction of the lower housing 20.

Accordingly, the inhaled air A5, some of the inhaled air to be discharged down from the lower housing 20 may be discharged slantingly from the lower housing 2, forming a whirling current of air as the auxiliary outlets 70 are arranged in the circumferential direction of the blower fan 50. The inhaled air A5 discharged while forming the whirling current of air may help the inhaled air A1 to be inhaled into the housing 10, 20 formed as a whirlwind.

The guide plane 71 may be slantingly formed toward the opposite direction to the rotational direction of the blower fan 50 such that the inhaled air A5 to be discharged down from the lower housing 20 is discharged down from the housing 20 along the rotational direction formed by the blower fan 50.

In other words, the guide plane 71 is slantingly arranged at an inclined angle to the direction in which the inhaled air A5 to be discharged down from the lower housing 20 is rotationally moved, allowing the inhaled air A5 to be discharged down from the lower housing 20 while being rotated with the least resistance.

As described above, the plurality of auxiliary outlets 70 are arranged a distance apart from each other along the circumferential direction of the inlet 21, in which case a plurality of auxiliary outlets 71*a* arranged nearer to the front of the microwave oven having a hood 1 than the rotation axis R of the blower fan 50 may have a smaller inclined angle than a plurality of auxiliary outlets 71*b* arranged nearer to the back of the microwave oven having a hood 1 than the rotation axis R.

With a larger inclined angle, the guide plane 71 may extend nearly vertically into the housing 10, 20, and with a smaller inclined angle, the guide plane 71 may extend nearly horizontally into the housing 10, 20.

Accordingly, on the occasion of the small inclined angle, the inhaled air A5 to be discharged down from the lower housing 20 may be discharged at an angle near to the horizontal direction of the lower housing 20.

When the inhaled air A5 to be discharged down from the lower housing 20 is discharged through the plurality of auxiliary outlets 71*a* arranged near to the front of the lower housing 20 in a direction perpendicular to the lower housing 20, an air curtain may be formed in the vertical direction.

As shown in FIG. 6, the microwave oven with a hood 1 typically has smaller width than the cooktop C in the front and back direction, so when the air curtain formed on the front of the lower housing 20 is formed only in the vertical direction, it prevents smoke generated from the front side of the cooktop C from being captured by the microwave oven having a hood 1.

In other words, when an air shield formed by the air curtain is formed somewhere above the cooktop C in the vertical direction, smoke or something generated from outside of the air shied may be prevented from being captured by the microwave oven having a hood 1, thereby reducing the capture efficiency.

Hence, by forming a small inclined angle of the guide plane 71 arranged at each of the plurality of auxiliary outlets 71*a* arranged near the front of the lower housing 20, the inhaled air A5 discharged down from the lower housing 20 may prevent an air curtain from being formed in the vertical direction.

In the inlet 21, an suction guide 30 for guiding the inhaled air A1 moving into the housing 10, 20 to be moved to the blower fan 50 in a rotational direction of the blower fan 50 may be arranged.

The inhaled air A1 moving into the housing 10, 20 forms a rising current of air by the blower fan 50, but when the inhaled air A1 moving to the housing 10, 20 is moved into the blower fan 50 in a direction perpendicular to the rotational direction of the blower fan 50 due to the rising, noise may occur on a side where the blower fan 50 and the inhaled air A1 moving into the housing 10, 20 collide, depriving the air of the rotation power and thus decreasing air-blowing efficiency.

To prevent this, the suction guide 30 may guide the inhaled air A1 moving into the housing 10, 20 to the same direction as the rotational direction of the blower fan 50, thereby allowing the air to be moved to the blower fan 50 without losing the rotation power.

The suction guide 30 may be arranged to match the opening of the inlet 21, and may include a plurality of guide wings 31 arranged radially from the center of the inlet 21.

A plurality of guide wings 31 may be arranged at an upward inclined angle in the rotational direction of the blower fan 50 to guide the inhaled air A1 moving into the housing 10, 20 to a direction corresponding to the rotational direction of the blower fan 50.

A duct 100 for the inhaled air arranged inside the housing 10, 20 will now be described in detail.

On an occasion of the conventional microwave oven having a hood, as described above, the blower fan is arranged in an upper portion of the housing to be adjacent to the outlet, so the inhaled air brought into the housing takes on negative pressure until passing through the blower fan.

This prevents the inhaled air brought into the housing from flowing in other directions than a flow path for the inhaled air to be moved to the outlet by the blower fan. Accordingly, the conventional microwave oven having a hood may force the inhaled air brought into the housing to be naturally moved to the blower fan and then to be discharged out of the housing through the outlet without a configuration of a duct.

On the contrary, in the microwave oven having a hood 1 according to an embodiment of the disclosure, the blower fan 50 is arranged in the lower portion of the housing 10, 20 to be adjacent to the inlet 21, the inhaled air A2 and A3 brought into the housing 10, 20 may take on positive pressure until being discharged out of the housing 10, 20 through the outlet 11.

Hence, if there is a space linked to the outside, which is created due to a gap of the housing 10, 20, apart from the outlet 11, the inhaled air A2 and A3 brought into the housing 10, 20 may not move to the outlet but to the space linked to the outside, and thus may be discharged back to a room where the microwave oven having hood 1 is installed, leading to a reduction in efficiency of the microwave oven having a hood 1.

To prevent this, the microwave oven having a hood 1 according to an embodiment of the disclosure may include the duct 100 sealed for the inhaled air A2 and A3 brought into the housing 10, 20 to be moved to the outlet 11 through the inlet 21.

Figure 7:
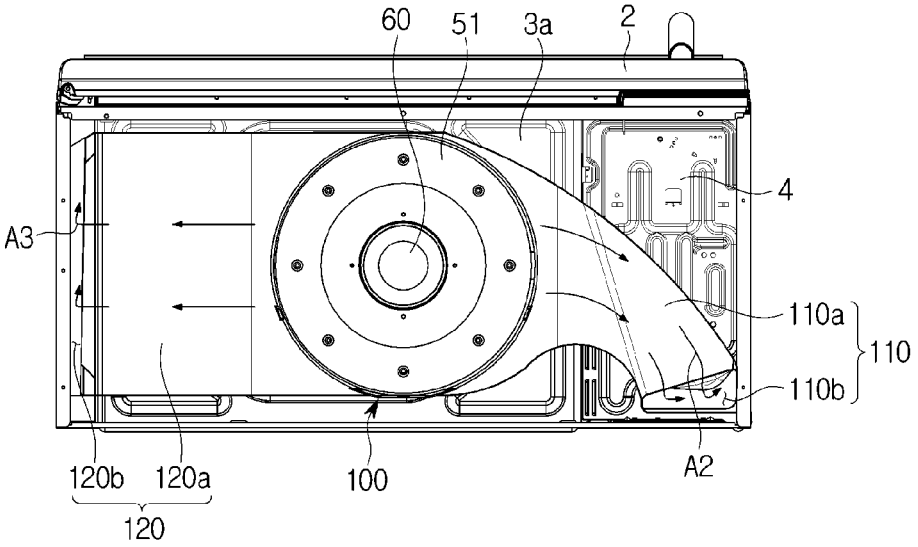
FIG. 7 is a perspective view of some parts of a microwave oven having a hood, according to an embodiment of the disclosure.
Figure 8:
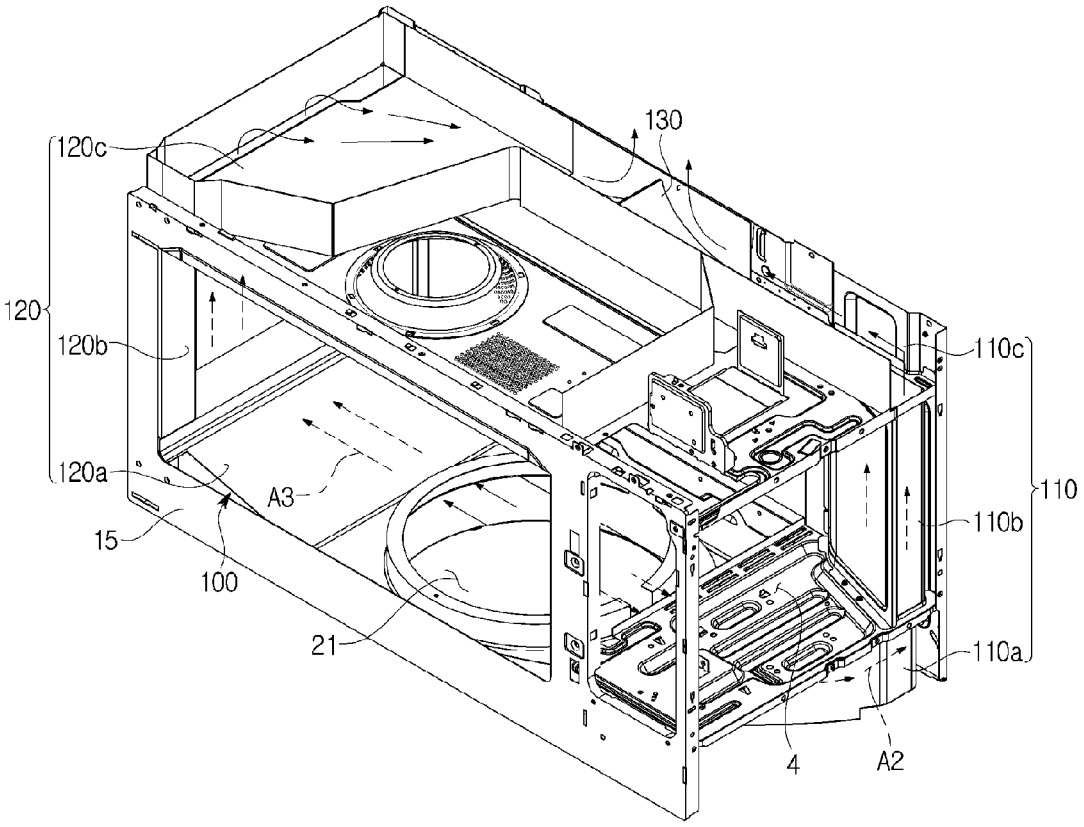
FIG. 8 is a bottom view of a microwave oven having a hood with a bottom housing removed therefrom, according to an embodiment of the disclosure.

As shown in FIGS. 7 an 8, a frame 15 may be included inside the housing 10, 20 to support the housing 10, 20. The upper housing 10 and the lower housing 20 may be attached to the frame 15, and the frame 15 may form at least one side of the electric room 4.

Inside the housing 10, 20, the duct 100 may be arranged to connect the inlet 21 to the outlet 11 in a sealed state. The duct 100 may be supported by the frame 15 inside the housing 10, 20.

The duct 100 may include a first flow path 110 which is a flow path for the inhaled air A2 moving to a side of the housing 10, 20 and a second flow path 120 which is a flow path for the inhaled air A3 moving to the other side of the housing 10, 20, the first and second paths centered at the inlet 21.

The first flow path 110 may include a first bottom flow path 110*a* formed for the inhaled air A2 moving to the one side to be moved from the bottom of the housing 10, 20 toward the one side, a first middle flow path 110*b* extending upward from the first bottom flow path 110*a* for the inhaled air A2 moving to the one side to be moved upward, and a first top flow path 110*c* for the inhaled air A2 moving to the one side to be moved from the first middle flow path 110*b* to the outlet 11.

When the duct 100 is arranged on one side of the housing 10 in the left and right direction, the electric room 4 arranged on one side of the housing 10 may become smaller or otherwise, the housing 10 may become larger in size to secure the space for the electric room 4. Hence, the first middle flow path 110*b* may be arranged behind the electric room 4 to prevent the need to increase the housing 10 in the left and right direction.

Accordingly, the inhaled air A2 to be moved to the one side may be moved into the housing 10, 20 through the inlet 21 along the first flow path 110, then moved to the one side of the housing 10, 20, then moved up in the housing 10, 20 in the back of the electric room 4, and then discharged to the inside of the housing 10, 20 through the outlet 11 formed on the top of the upper housing 10.

The second flow path 120 may include a second bottom flow path 120*a* formed for the inhaled air A3 moving to the other side to be moved from the bottom of the housing 10, 20 toward the other side, a second middle flow path 120*b* extending upward from the second bottom flow path 120*a* for the inhaled air A2 moving to the other side to be moved upward, and a second top flow path 120*c* for the inhaled air A2 moving to the other side to be moved from the second middle flow path 120*b* to the outlet 11.

Accordingly, the inhaled air A3 to be moved to the other side may be moved into the housing 10, 20 through the inlet 21 along the second flow path 120, then moved to the other side of the housing 10, 20, then moved up in the other side of the housing 10, 20, and then discharged to the inside of the housing 10, 20 through the outlet 11 formed on the top of the upper housing 10.

Bottom sides of the first bottom flow path 110*a* and the second bottom flow path 120*a* may be formed by the lower housing 20. Accordingly, some of the inhaled air A2 moving along the first flow path 110 and inhaled air A3 moving along the second flow path 120 may be discharged downward through the auxiliary outlet 70.

It is not, however, limited thereto, and to strengthen the air tightness of the duct 100, the bottom sides of the first and second bottom flow paths 110*a* and 120*a* may be formed with separate members from the lower housing 20 and strongly coupled with the first and second bottom flow paths 110*a* and 120*a*.

Additional linkage members may be provided between the first and second bottom flow paths 110*a* and 120*a* and the auxiliary outlet 70 to link the first and second bottom flow paths 110*a* and 120*a* to the auxiliary outlet 70.

With the duct 100 in the microwave oven having a hood 1 according to an embodiment of the disclosure, the inhaled air A2, A3, and A5 inhaled into the housing 10, 20 may be moved around along a total of three flow paths, a flow path on one side of the housing, a flow path on the other side of the housing, and an auxiliary discharging flow path. Among the paths, the flow path on one side of the housing and the flow path on the other side of the housing may allow air to be moved to the outlet 11 and discharged out of the housing, and the auxiliary discharging flow path may allow the air out of the housing through the auxiliary outlet 70.

It is not limited thereto, and the duct 100 may not be divided into the first and second flow paths 110 and 120 but be formed into a single flow path. Just one of the first and second flow paths 110 and 120 may be arranged, or all the flow paths may be arranged near the rear side of the housing 10, 20 between the back of the cooking chamber 3 and electric room 4 and the housing 10, 20. In this case, the microwave oven having a hood 1 may force the inhaled air brought into the housing to be moved around along the two flow paths, the auxiliary discharging flow path and a flow path inside the housing.

The first and second top flow paths 110*c* and 120*c* may be linked to a discharging flow path 130 arranged near the outlet 11 of the upper housing 10. The discharging flow path 130 may include a first opening linked to the first top flow path 110*c*, a second opening linked to the second top flow path 120*c*, and a third opening for the inhaled air to be discharged.

The first to third openings may be connected and formed to have three open sides as shown in this embodiment of the disclosure, or without being limited thereto, may be formed as separate openings.

The discharging flow path 130 may be arranged to be linked to each of the first and second flow paths 110 and 120 as described above, so the inhaled air A2 moving around along the first flow path 110 and the inhaled air A3 moving around along the second flow path 120 may join there and may be discharged through the outlet 11.

As described above, the outlet 11 may be arranged on the top of the upper housing 10, but without being limited thereto, may be arranged on the rear or front of the upper housing 10. This is because the position of the outlet 11 may be changed depending on where an exhaust device for exhausting air is located in the space where the microwave oven having a hood 1 is arranged.

On the occasion of the conventional microwave oven having a hood, as described above, the inhaled air inside the housing takes on negative pressure, so that the inhaled air may be easily moved to the outlet regardless of where the outlet is formed.

On the contrary, in the microwave oven having a hood 1 according to an embodiment of the disclosure, it may be difficult to form the outlet 11 at an arbitrary position because of the duct 100 formed in the housing 10, 20 for the inhaled air A2 and A3 to be moved around.

To solve this problem, it is possible to easily discharge the inhaled air A2 and A3 through the outlet 11 by a change of direction of the discharging flow path 130 rather than entire change of the duct 100.

Figure 9:
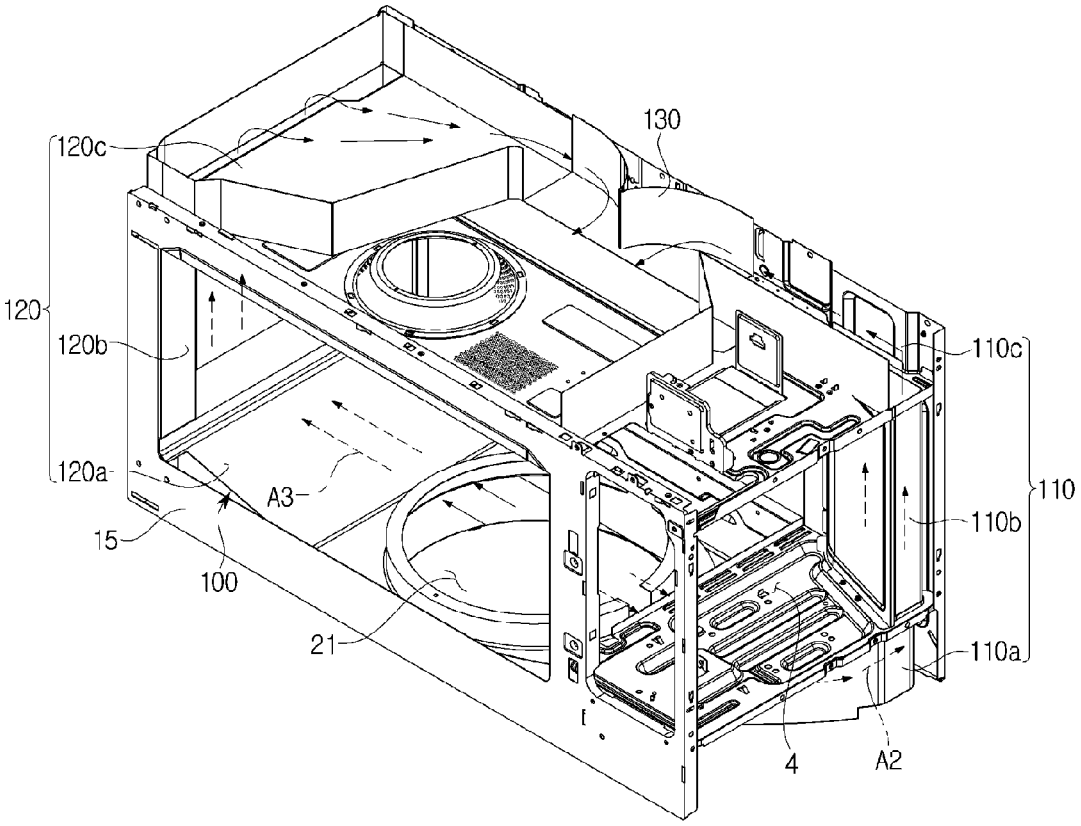
FIG. 9 is a perspective view of some parts of a microwave oven having a hood with an outlet flow path arranged toward the front, according to an embodiment of the disclosure.
Figure 10:
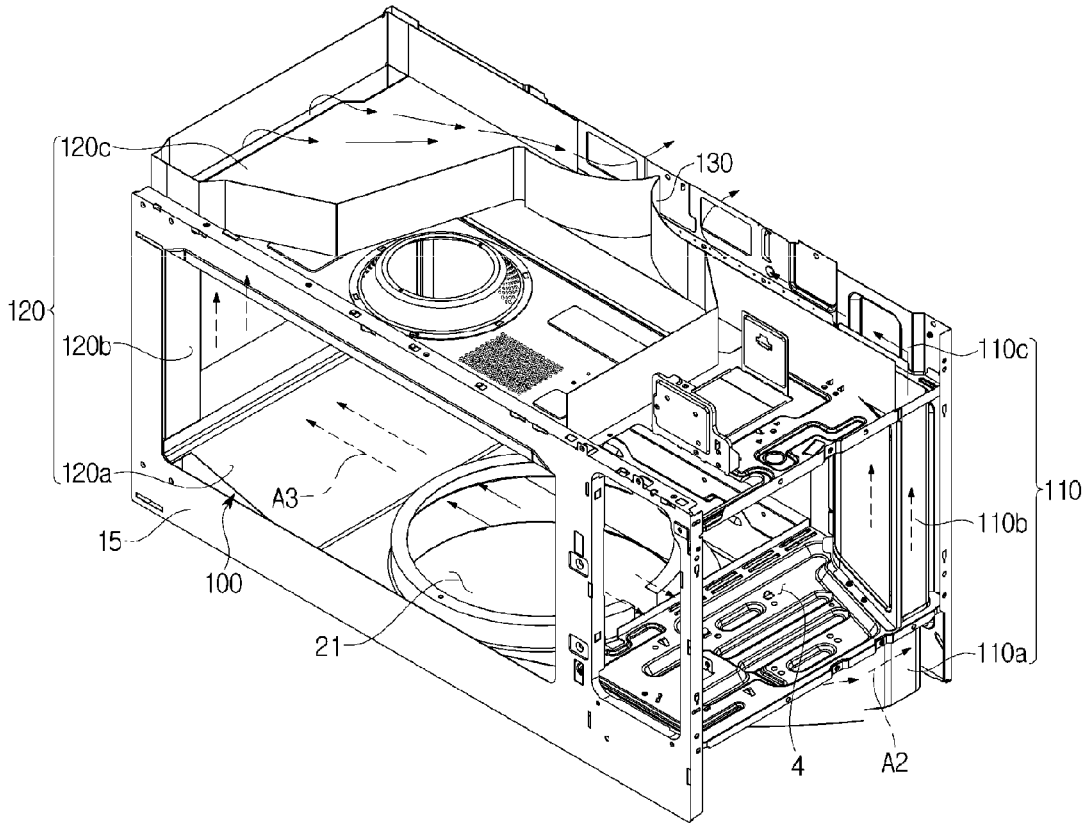
FIG. 10 is a perspective view of some parts of a microwave oven having a hood with an outlet flow path arranged to the back, according to an embodiment of the disclosure.

Specifically, as shown in FIGS. 9 and 10, in a case of having to discharge the inhaled air A2 and A3 brought into the housing 10, 20 toward the front of the housing 10, 20, the third opening of the discharging flow path 130 may be arranged toward the front (see FIG. 9) to discharge the inhaled air A2 and A3 brought into the housing 10, 20 toward the front.

Furthermore, in a case of having to discharge the inhaled air A2 and A3 brought into the housing 10, 20 toward the back, the third opening of the discharging flow path 130 may be arranged toward the back (see FIG. 10) to discharge the inhaled air A2 and A3 brought into the housing 10, 20 toward the back.

As such, as the third opening of the discharging flow path 130 may be arranged upward, forward, or backward, the inhaled air A2 and A3 brought into the housing 10, 20 may be easily moved to the outlet 11.

The microwave oven having a hood 1 according to another embodiment of the disclosure will now be described. Configurations other than a discharging guide 80 are the same as those of the microwave oven having a hood 1 according to the previous embodiment, so the overlapping description thereof will not be repeated.

Figure 11:
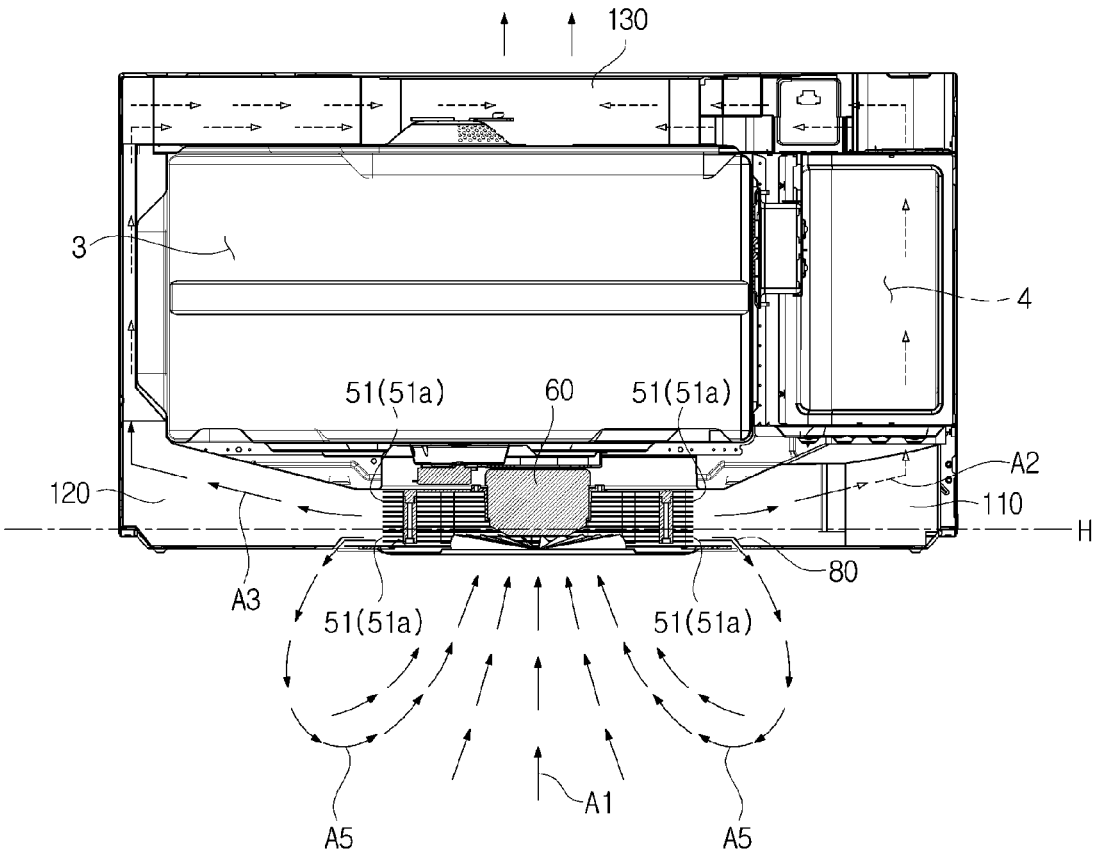
FIG. 11 is a cross-sectional view of a microwave oven having a hood, according to another embodiment of the disclosure.

As shown in FIG. 11, the discharging guide 80 may be radially arranged outside the lower disc 51*a* arranged on the lower side of the plurality of discs 52 to guide the inhaled current A5 to be discharged to the auxiliary outlet 70 to the auxiliary outlet 70.

The discharging guide 80 may extend to the base height H to which the lower discs 51*a* of the plurality of discs 51 rotated for the inhaled air A5, some of the inhaled air brought into the housing 10, 20, to be directed to the auxiliary outlet 70 are layered.

This may enable the inhaled air A5, some of the inhaled air brought into the housing 10, 20, which is moving around along the lower discs 51*a*, to be easily moved to the auxiliary outlet 70 by the discharging guide 80 to be discharged down from the housing 10, 20

The microwave oven having a hood 1 according to another embodiment of the disclosure will now be described. Configurations other than auxiliary outlets 70' and 70" are the same as those of the microwave oven having a hood 1 according to the previous embodiment, so the overlapping description thereof will not be repeated.

Figure 12:
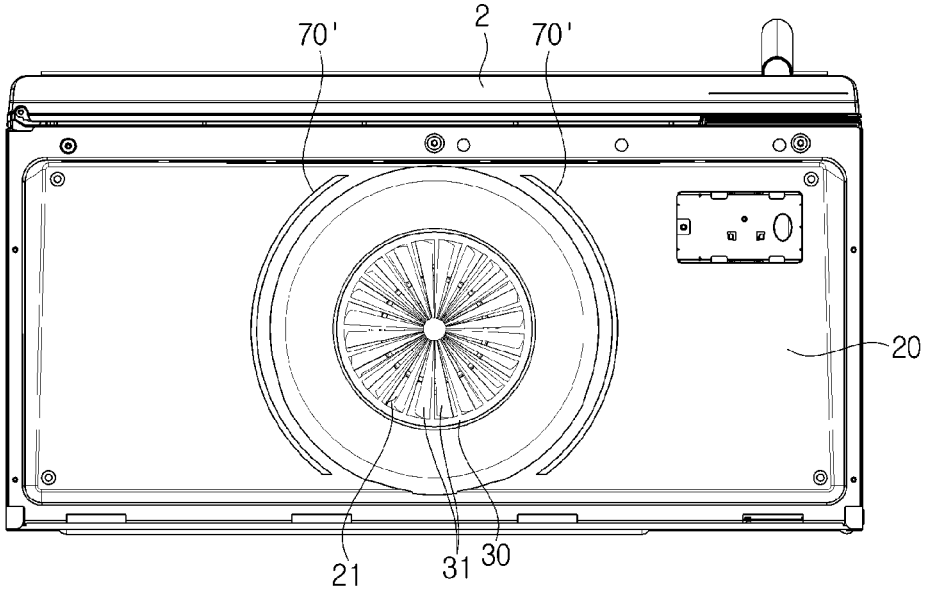
FIG. 12 is a bottom view of a microwave oven having a hood, according to another embodiment of the disclosure.

As shown in FIG. 12, an auxiliary outlet 70' may be provided to run along the circumferential direction of the blower fan 50 or the inlet 21. In other words, the auxiliary outlet 70' may be arranged along the circumferential direction of the blower fan 50 or the inlet 21 to have the form of an arc.

The inhaled air A2 and A3 brought into the housing 10, 20 and moved by the blower fan 50 may be moved in the rotational direction of the blower fan 50, and discharged down from the lower housing 20 through the auxiliary outlet 70' of the arc shape formed along the circumferential direction of the blower fan 50 without limitation of moving.

Although not shown, a guide plane may be formed at an inclined angle on an inner side of the auxiliary outlet 70', and the inclined angle of the guide plane may be changed along the circumferential direction.

Figure 13:
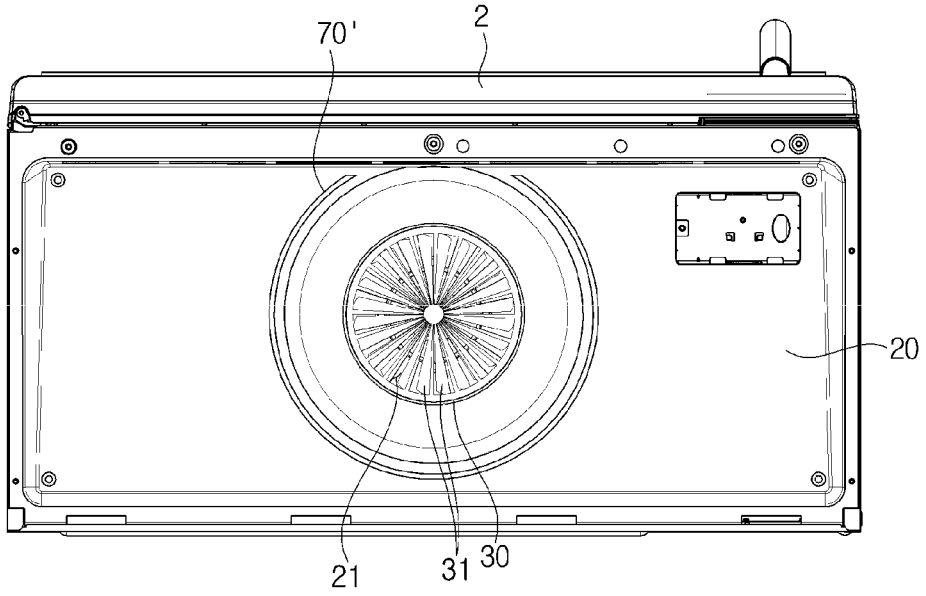
FIG. 13 is a bottom view of a microwave oven having a hood, according to another embodiment of the disclosure.

As shown in FIG. 13, an auxiliary outlet 70" may be provided in the form of a disc with a cut-out part along the circumferential direction of the blower fan 50 or the inlet 21.

The inhaled air A2 and A3 brought into the housing 10, 20 and moved by the blower fan 50 may be moved in the rotational direction of the blower fan 50, and discharged down from the lower housing 20 through the auxiliary outlet 70" of the disc shape formed along the circumferential direction of the blower fan 50 without limitation of moving.

The cut-out part of the auxiliary outlet 70" in the disc shape may be arranged near the front of the lower housing 20. This may minimize the amount of an air curtain to be formed near the front of the lower housing 20, allowing smoke generated from an upper front side of the cooktop C to be easily inhaled into the inlet 21.

The microwave oven having a hood 1 according to another embodiment of the disclosure will now be described. Configurations other than an electric room inlet 115 and an electric room outlet 116 are the same as those of the microwave oven having a hood 1 according to the previous embodiment, so the overlapping description thereof will not be repeated.

Figure 14:
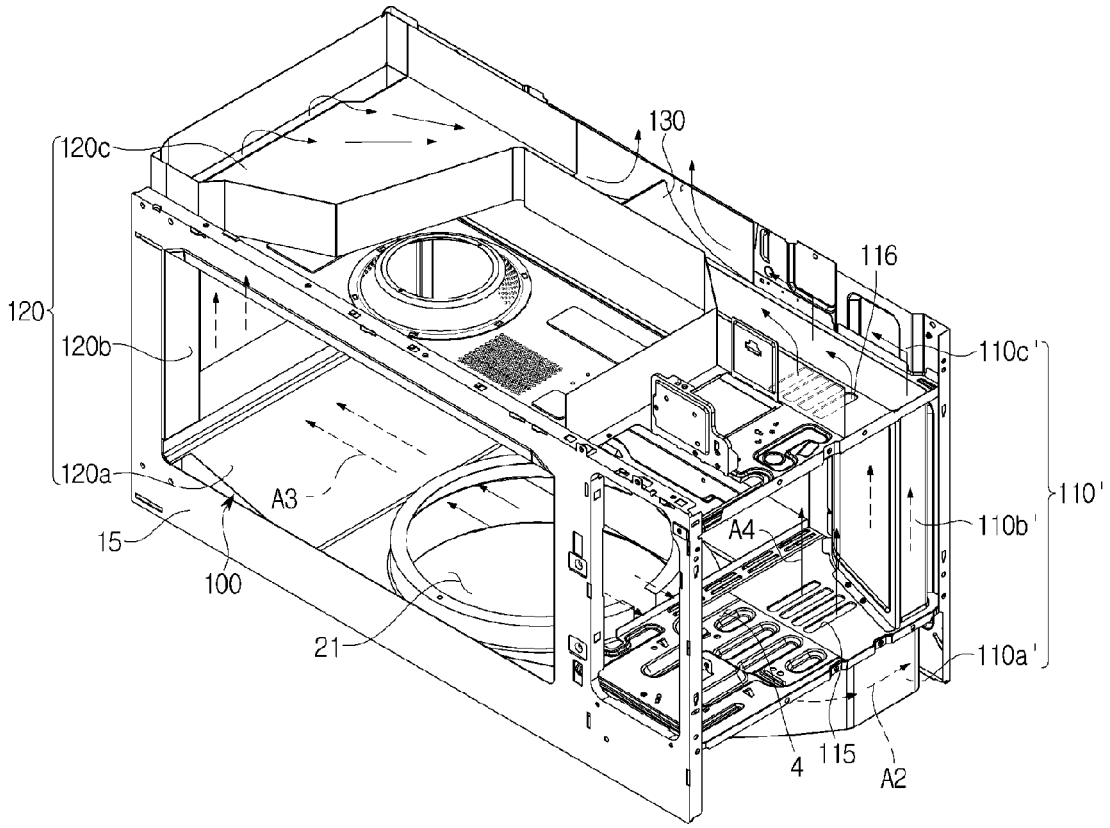
FIG. 14 is a perspective view of some parts of a microwave oven having a hood, according to another embodiment of the disclosure.
Figure 15:
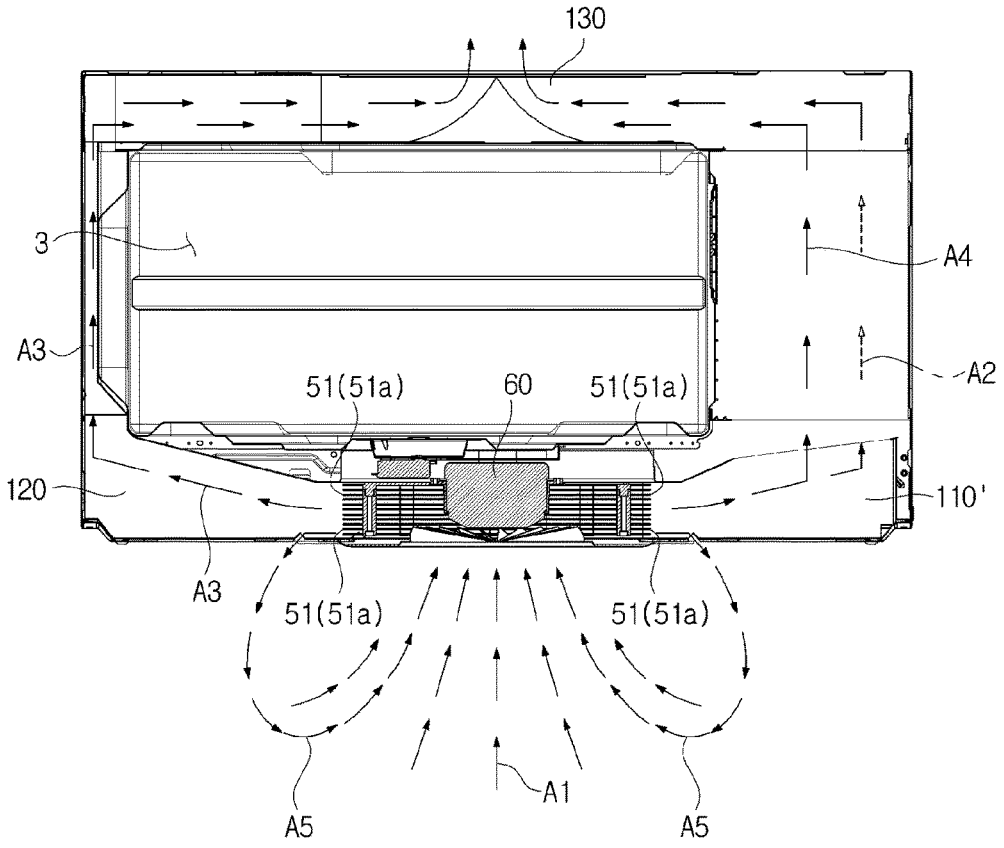
FIG. 15 is a cross-sectional view of FIG. 14.

As shown in FIGS. 14 and 15, the electric room inlet 115 and the electric room outlet 116 linked to the electric room 4 may be provided in a first flow path 110' for some of the inhaled air A4 directed toward a side of the housing 10, 20 to be moved into the electric room 4.

The inhaled air A4 moved into the electric room 4 may cool various electric parts arranged inside the electric room 4 while moving around in the electric room 4. This allows the electric parts to be cooled without need for installing an additional cooling fan inside the electric room 4.

Specifically, the electric room inlet 115 linked to the electric room 4 is provided on the top of a first bottom flow path 110*a*' to allow some of the inhaled air A2 moving to a side of the housing 10, 20 to be moved into the electric room 4.

The inhaled air A4 moved into the electric room 4 may be moved around inside the electric room 4, then may join the inhaled air A2 moving to a side of the housing 10, 20 inside a first top flow path 110*c*' through the electric room outlet 116 formed on the bottom of the first top flow path 110*c*', and may be moved to the discharging flow path 130.

Some of the inhaled air A2 having not passed through the electric room inlet 115 from the first bottom flow path 110*a*' may be moved into a first middle flow path 110*b*', then into the first top flow path 110*c*', and then into the discharging flow path 130.

Hence, in the first flow path 110, a new flow path on the side of the electric room 4 may be formed to pass the electric room 4, apart from the existing flow path on the one side of the housing along which the inhaled air A2 is moved. Accordingly, since the inhaled air A2, A3, and A4 may be discharged out of the housing 10, 20 through the outlet 11 after being moved around inside the housing 10, 20 through a total of three flow paths, which are the flow path on one side of the housing, the flow path on the other side of the housing, and the flow path on the side of the electric room, and may produce the inhaled air A5 to be discharged through the auxiliary outlet 70 along an auxiliary discharging flow path, the inhaled air A2, A3, A4, and A5 may be discharged out of the housing 10, 20 after being moved around inside the housing 10, 20 through the total of four flow paths.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

The invention claimed is:

1. A cooking apparatus having a hood comprising:

a housing including an outlet and an inlet;

a cooking chamber arranged inside the housing;

a blower fan disposed between a bottom side of the cooking chamber and the housing; and at least one auxiliary outlet formed on the bottom side of the housing and disposed around and outside the blower fan in a radial direction of the blower fan, wherein the at least one auxiliary outlet is arranged along a circumferential direction of the blower fan, wherein the blower fan is configured to rotate around a rotation axis aligned vertically to the housing, and force inhaled air inhaled into the housing to be rotated in the circumferential direction of the blower fan, and wherein the at least one auxiliary outlet is provided for some of the inhaled air inhaled into the housing to be discharged down from the housing.

2. The cooking apparatus having the hood of claim 1, wherein the blower fan is a centrifugal fan, and comprises a plurality of disc plates layered vertically.

3. The cooking apparatus having the hood of claim 2, wherein among the plurality of disc plates, a plurality of disc plates arranged in a lower side are configured to force some of the inhaled air brought into the housing to be moved to the at least one auxiliary outlet.

4. The cooking apparatus having the hood of claim 3, further comprising: a discharging guide arranged around and outside the plurality of disc plates arranged in the lower side among the plurality of disc plates to guide some of the inhaled air to the at least one auxiliary outlet.

5. The cooking apparatus having the hood of claim 1, further comprising a suction guide guiding the inhaled air into the housing in a direction in which the blower fan is rotated, and comprising a plurality of guide wings radially formed at the inlet.

6. The cooking apparatus having the hood of claim 5, wherein the plurality of guide wings are arranged at an upward inclined angle in a rotational direction of the blower fan.

7. The cooking apparatus having the hood of claim 1, wherein the at least one auxiliary outlet comprises a guide plane guiding some of the inhaled air to be discharged at the inclined angle with the rotation axis, and is formed at the inclined angle with the rotation axis toward the inside of the housing.

8. The cooking apparatus having the hood of claim 7, wherein the guide plane of some of the at least one auxiliary outlet arranged in a front area with respect to the rotation axis has a different inclined angle from the guide plane of the other of the at least one auxiliary outlet arranged in a rear section with respect to the rotation axis.

9. The cooking apparatus having the hood of claim 7, wherein the guide plane of each of the at least one auxiliary outlet has a different inclined angle.

10. The cooking apparatus having the hood of claim 1, further comprising: a front auxiliary outlet formed toward the front of the housing for some of the inhaled air brought into the housing to be discharged toward the front of the housing.

11. The cooking apparatus having the hood of claim 1, further comprising: a duct linked from the inlet to the outlet.

12. The cooking apparatus having the hood of claim 11, further comprising: an electric room arranged on a side to the cooking chamber and having electric parts arranged in the electric room, wherein the duct comprises an electric room inlet provided for the inhaled air brought into the housing to be moved into the electric room, and an electric room outlet provided for the inhaled air brought into the electric room to be discharged.

13. The cooking apparatus having the hood of claim 1, wherein the auxiliary outlet is arranged on a bottom side of the housing for some of the inhaled air to be discharged down from the housing, and for some of the inhaled air discharged down from the housing to form an air curtain around the inlet.

* * * * *